US007017207B2

(12) United States Patent
Lauderman

(10) Patent No.: US 7,017,207 B2
(45) Date of Patent: Mar. 28, 2006

(54) SIZE IDENTIFICATION SYSTEM FOR BED SHEETS AND THE LIKE

(75) Inventor: Jennifer L. Lauderman, Cincinnati, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 0 days.

(21) Appl. No.: 10/741,126

(22) Filed: Dec. 19, 2003

(65) Prior Publication Data

US 2005/0132493 A1 Jun. 23, 2005

(51) Int. Cl.
*A47G 9/02* (2006.01)
*D05B 19/00* (2006.01)

(52) U.S. Cl. ..... 5/495; 5/482; 112/470.05

(58) Field of Classification Search ..... 5/495, 5/482, 488; 112/470.05, 130, 141; 442/312–314
See application file for complete search history.

(56) References Cited

U.S. PATENT DOCUMENTS

| | | | | | |
|---|---|---|---|---|---|
| 835,083 | A | * | 11/1906 | Strahi | 139/417 |
| 1,907,393 | A | | 5/1933 | Tooley | 40/672 |
| 2,059,092 | A | | 10/1936 | Donovan | 40/662 |
| 2,059,096 | A | | 10/1936 | Goodchild | 40/662 |
| 2,272,229 | A | | 2/1942 | Tucker | 28/169 |
| 2,546,831 | A | * | 3/1951 | Newell | 112/470.05 |
| 2,738,746 | A | * | 3/1956 | MacIsaac, Jr. et al. | 112/470.12 |
| 3,477,397 | A | * | 11/1969 | Hawley | 112/2 |
| 3,489,113 | A | * | 1/1970 | Flanagan | 112/2 |
| 3,580,198 | A | * | 5/1971 | Teed et al. | 112/470.05 |
| 3,926,227 | A | * | 12/1975 | Takada et al. | 139/383 R |
| 4,191,221 | A | * | 3/1980 | Boyer | 139/426 R |
| 4,269,130 | A | * | 5/1981 | Burton et al. | 112/475.06 |
| 4,271,767 | A | * | 6/1981 | Burton et al. | 112/2 |
| 4,287,841 | A | * | 9/1981 | Rovin | 112/470.03 |
| 4,473,373 | A | | 9/1984 | Weiss | 8/137 |
| 4,802,250 | A | * | 2/1989 | Farr | 5/482 |
| 4,934,939 | A | * | 6/1990 | Bonneville | 434/247 |
| 5,208,926 | A | * | 5/1993 | Stackhouse | 5/482 |
| 5,424,117 | A | * | 6/1995 | Heiman et al. | 442/189 |
| 5,655,236 | A | | 8/1997 | Murray | 5/495 |

(Continued)

OTHER PUBLICATIONS

See the Assignee's Reference A.R. statement in the accompanying transmittal letter.

(Continued)

*Primary Examiner*—Robert G. Santos
(74) *Attorney, Agent, or Firm*—Wood, Herron & Evans, LLP

(57) ABSTRACT

A size-identification system for bed sheets and the like is developed at the stage of weaving the greige fabric from which the bed sheets are made. One woven greige fabric (12) has a colored warp yarn (14') in a selvage (20). A bed sheet (24) made from the fabric (12) has a selvage (26) which includes a colored warp yarn (30). Another woven greige fabric (38) has a plurality of colored filling yarns (44'), with each filling yarn (44') being spaced a predetermined distance from an adjacent filling yarn (44') along the length of the fabric (38), so as to have one of the yarns (44') located in a preselected section of a bed sheet (50) made from the fabric (38). A bed sheet (50) made from the fabric (38) has a colored filling yarn (64) located in a lower-end section (58) of the bed sheet (50).

16 Claims, 2 Drawing Sheets

U.S. PATENT DOCUMENTS

| | | | | |
|---|---|---|---|---|
| 5,697,329 | A | 12/1997 | Bell et al. | 119/857 |
| 5,807,794 | A * | 9/1998 | Knox et al. | 442/306 |
| 5,855,991 | A * | 1/1999 | McLarty, III | 428/195.1 |
| 5,913,277 | A * | 6/1999 | Resta | 112/470.12 |
| 6,230,341 | B1 * | 5/2001 | Dudley | 5/482 |
| 6,263,816 | B1 | 7/2001 | Codos et al. | 112/475.08 |
| 6,772,530 | B1 * | 8/2004 | Nennig | 33/562 |
| 2005/0132493 | A1 * | 6/2005 | Lauderman | 5/495 |

OTHER PUBLICATIONS

European Search Report Indicating a Mar. 24, 2005 completion data (corresponding to European Patent Application No. 04257664).

Anonymous Internet Article Entitled "Bed Sheet Indicator-Always find the size you are looking for", from URL:http://www.halfbakery.com/idea/bed__20Sheet__20Indicator Retrieved on Mar. 20, 2005.

* cited by examiner

SIZE IDENTIFICATION SYSTEM FOR BED SHEETS AND THE LIKE

BACKGROUND OF THE INVENTION

1. Field of the Invention

This invention is directed to bed sheets and the like, and more particularly, to such items having indicators for distinguishing one size from another.

2. Description of Related Art

Facilities such as hospitals, hotels, other lodging facilities, and the laundries (either onsite or offsite) that serve these commercial facilities handle large volumes of launderable products, for example, sheets, pillow cases, towels, and blankets. Significant time and energy is expended in managing these types of linens, especially with respect to the sizes thereof. By way of example, differently-sized bed sheets typically look alike when mixed together in the laundry process, and therefore laundry workers spend a great deal of time separating and sorting the sheets by size. In addition, even though cleaned sheets may be stored by size, housekeeping workers spend a significant amount of time verifying sheet sizes—both at a given storage location and during the room-to-room housekeeping process.

To help reduce the time for those who use or handle the sheets, a size indicator has typically been added to the sheets. In this regard, a textile mill will weave a roll of fabric of a certain width. The width corresponds, generally, to the width of the bed sheets to be made therefrom. In a separate set of operations, each bed sheet is formed by cutting a length of fabric from the roll, and then sewing or hemming the edges as necessary to provide the appearance of the finished sheet. The size indicator is typically added as part of the forming process, which thus occurs long after the roll of fabric is woven. By way of example, one of the seams, such as along the head of the sheet, may be sewn with a colored seaming thread, rather than a white seaming thread, as is typically used for the seams. However, colored seaming thread is more expensive than white seaming thread. Also, errors often occur in the sewing machine setup, which result in the wrong colored thread being used. The result is costly waste.

SUMMARY OF THE INVENTION

The present invention provides a size-indicating system for linens, such as bed sheets and the like, which reduces or eliminates the waste involved in providing size indicators as part of the post-roll cutting or sewing operations. To this end, and in accordance with the principles of the present invention, the size indication is accomplished by including a yarn having a predetermined color as one of the warp or filling yarns during the weaving of the fabric, with the color being correlated to an intended size of the bed sheet to be made therefrom. The yarn is positioned so that it will be visible in the formed sheet, so as to indicate the size thereof to those who subsequently handle the sheet. However, colored weaving threads do not present a significant cost differential, nor are there likely to be setup errors that result in use of the wrong colored thread.

Typically, the selvage edge of the roll will correspond to the lengthwise edge of the bed sheet. In accordance with one aspect of the present invention, the colored thread will be a warp yarn in the selvage, although it may be in another portion of the roll generally parallel to the selvage. Alternatively, the colored yarn may be in the fill so as to be generally transverse to the selvage. The resulting bed sheet in that situation will have a colored thread running transverse to the lengthwise edge thereof, and may even be positioned so as to appear adjacent the hem where the prior colored seaming thread would have been placed.

By virtue of the foregoing, there is thus provided a size-indicating system for linens, such as bed sheets and the like, which reduces or eliminates the waste involved in providing size indicators as part of the post-roll cutting or sewing operations. These and other advantages of the present invention will be apparent from the accompanying drawings and description of the drawings.

BRIEF DESCRIPTION OF THE DRAWINGS

The accompanying drawings, which are incorporated in, and constitute a part of this specification, illustrate embodiments of the invention, and, together with the general description of the invention given above, and the detailed description of the drawings given below, serve to explain the principles of the invention. The drawings are schematic, and are not to scale.

DETAILED DESCRIPTION OF THE DRAWINGS

Figure 1:
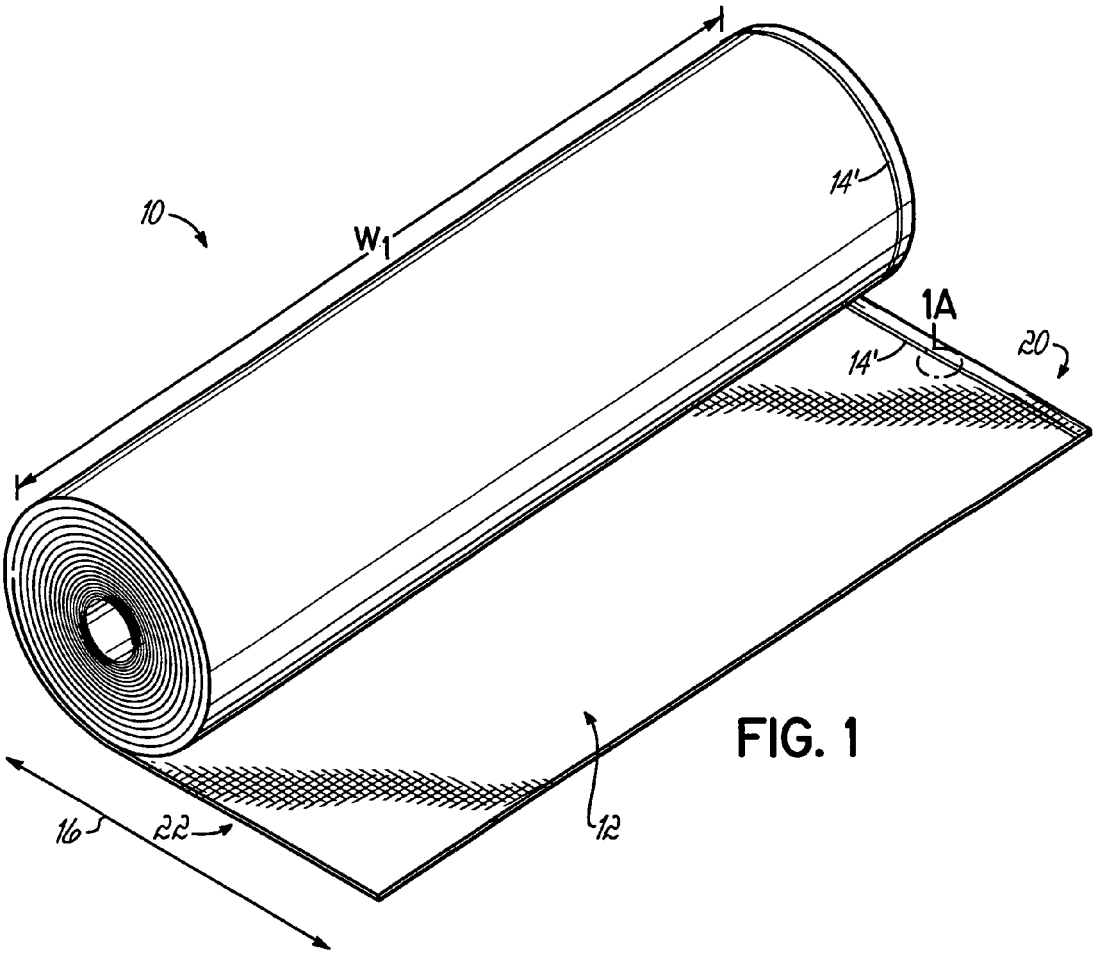
FIG. 1 is a perspective view of a roll of a woven greige fabric in accordance with the principles of the invention.
Figure 1A:
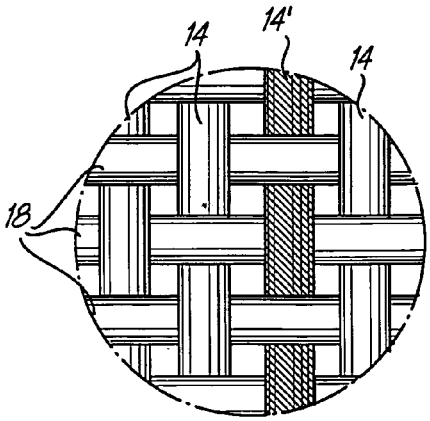
FIG. 1A is an enlarged fragmentary elevational view of a portion of the fabric of FIG. 1.

With reference to FIGS. 1 and 1A, a roll 10 of greige fabric 12 (i.e., a fabric which has not yet received a finish treatment) is woven in a conventional fashion, with a plurality of warp yarns 14 running the length of the fabric 12 (i.e., parallel to the longitudinal axis 16 thereof and a plurality of filling yarns 18 running across the fabric (i.e., transverse to axis 16). The fabric 12 has a first lengthwise edge in the form of a first selvage 20, and a second lengthwise edge in the form of a second selvage 22. The fabric 12 from roll 10 will be cut and sewn into a bed sheet 24 shown in FIG. 2, with the selvages 20, 22 of the fabric 12 corresponding generally with the selvages 26, 28 of the bed sheet 24. As used herein, the term "warp yarn" includes both warp yarn and selvage yarn, unless specifically noted otherwise.

In accordance with the principles of the present invention, roll 10 is woven with at least one of the warp yarns 14 or filling yarns 18 being of a predetermined color corresponding, in this embodiment, to the width $W_1$ of fabric 12 transverse to axis 16, which in turn will correlate to the width $W_2$ of the bed sheet 24, as will be described. In the embodiment of FIGS. 1 and 1A, the colored yarn is selected as a warp yarn 14', and further advantageously is in the selvage 20 of the fabric 12. For the sake of illustration, warp yarn 14' is shown as having a green color.

Although the fabric 12 shown in FIGS. 1 and 1A includes a single colored warp yarn 14' located in the selvage 20, a colored yarn may be woven in any of the warp-yarn locations of the weave. In addition, multiple colored warp yarns may be used. Advantageously the colored warp yarn is similar in composition and size to the other warp yarns in the fabric. For example, if the non-colored warp yarns are 50/50 cotton/polyester yarns of a particular size, then the colored warp yarn may have this same composition and size.

As will be appreciated, the size-identification system of the invention may be achieved in any suitable fashion. Advantageously, a given woven fabric includes at least one colored yarn that is distinctly and visually different from the color of the remainder of the fabric. If desired, each fabric that correlates to a different sheet size may be woven with a differently-colored yarn. For example, a blue yarn may designate twin, a green yarn may designate full, and a red yarn may designate king. In addition, a plurality of like-colored- or differently-colored-yarns may be used in weaving a given fabric, to designate a particular sheet size. For example, in the weaving process, a yellow yarn may be aligned adjacent a blue yarn, with the blue yarn being aligned adjacent another yellow yarn. Also, colored yarn(s) in which a given yarn has a particular pattern, or spacing, of a color along the length of that yarn may be used. And, if desired, different weave patterns may be used. For example, a woven greige fabric having a first float pattern may be used to make sheets having a first size, and a woven greige fabric having a second (or no) float pattern may be used to make sheets having a second size. If different weave patterns are used, the different sizes of the resulting sheets may be distinguished even if an identically-colored yarn is used to form the fabric.

Figure 2:
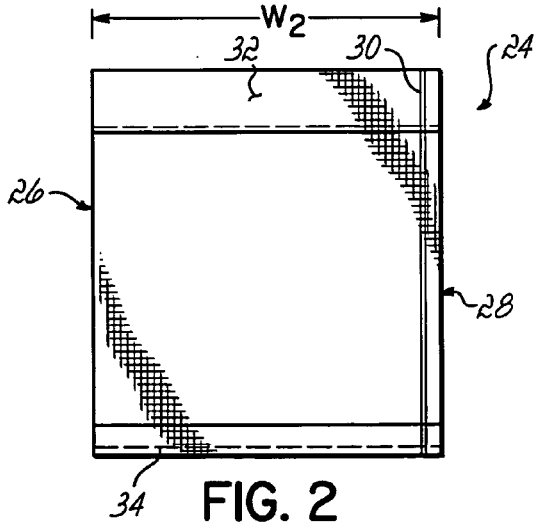
FIG. 2 is an elevational view of a flat bed sheet made from the fabric of FIG. 1.

With reference to FIG. 2, the flat bed sheet 24 made from the fabric 12 of FIG. 1 has selvages 26, 28 corresponding with the selvages 20, 22 of the fabric 12. The selvage 26 includes a colored warp yarn 30 corresponding with the yarn 14' of the fabric 12. The sheet 24 also has an upper hem 32 and a lower hem 34. In addition, the sheet 24 has a width $W_2$ which is substantially similar to the width $W_1$ of the fabric 12. The width $W_2$ may be slightly different from the width $W_1$ if, for example, the sheet 24 has received one or more finishing treatments such as those mentioned below. The sheet 24 may be made from the fabric 12 using customary methods and equipment, including, for example, any desired finishing treatment, cutting, and sewing. Examples of finishing treatments include the application of a no-iron finish, a no-stain finish, an optical brightener, and/or a color. As will be appreciated by one of ordinary skill, such finishing treatments may be applied to a woven greige fabric or to the sheets which have been made from the fabric.

Figure 3:
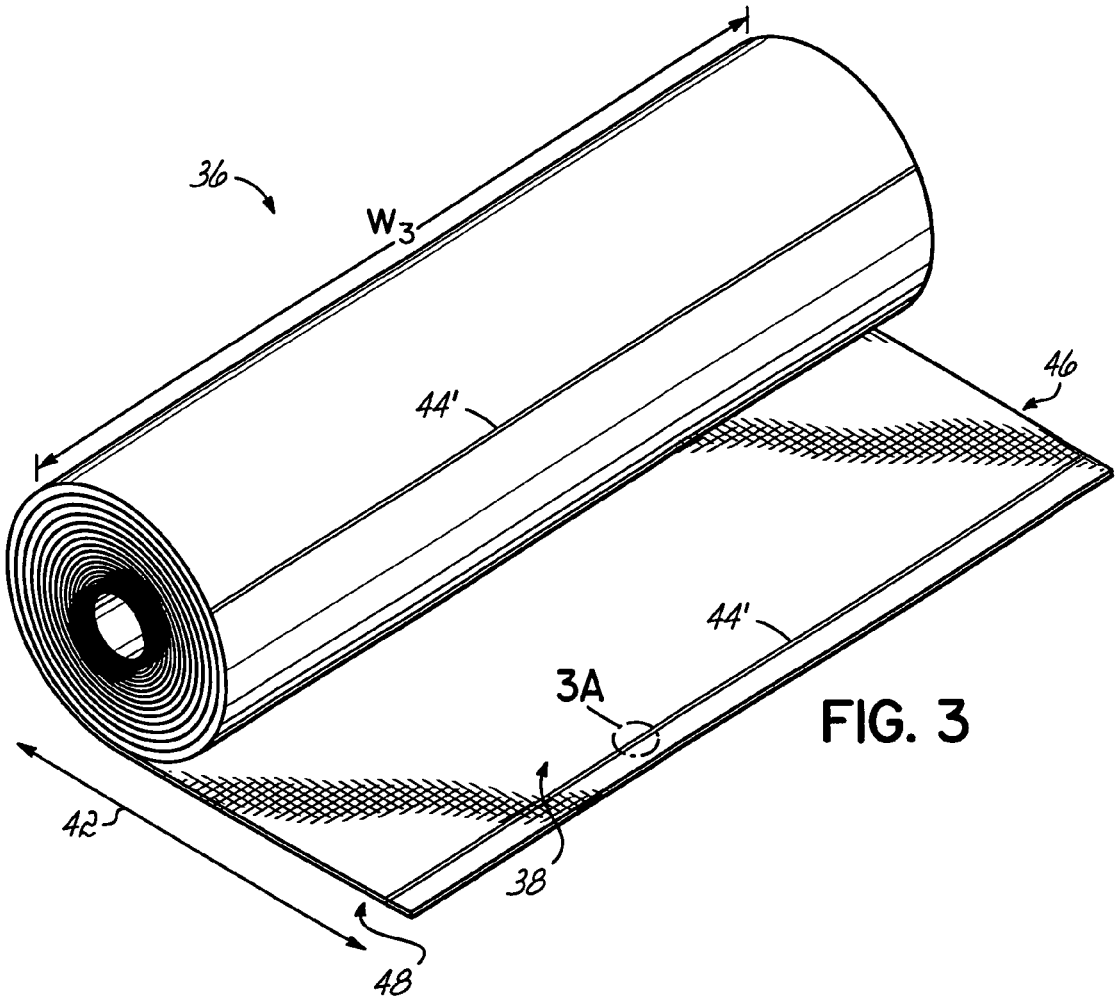
FIG. 3 is a perspective view of another woven greige fabric in accordance with the principles of the invention.
Figure 3A:
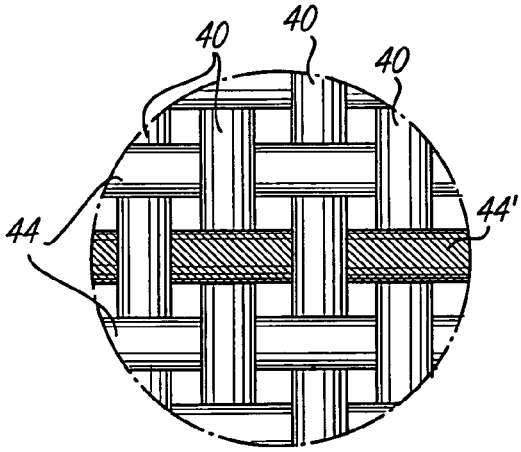
FIG. 3A is an enlarged fragmentary elevational view of a portion of the fabric of FIG. 3.

With reference to FIGS. 3 and 3A, a roll 36 of greige fabric 38 is woven in a manner generally similar to that of the fabric 12 shown in FIG. 1, with a plurality of warp yarns 40 running the length of the fabric 38 (i.e., parallel to the longitudinal axis 42 thereof) and a plurality of filling yarns 44 running across the fabric 38 (i.e., transverse to axis 42). The fabric 38 also has a first lengthwise edge in the form of a first selvage 46, and a second lengthwise edge in the form of a second selvage 48. The fabric 38 from roll 36 will be cut and sewn into a bed sheet 50 shown in FIG. 4, with the selvages 46, 48 of the fabric 38 corresponding generally with the selvages 52, 54 of the bed sheet 50.

In accordance with the principles of the invention, roll 36 is woven with a plurality of colored filling yarns, as at 44', being of a predetermined color which corresponds, in this embodiment, to the width $W_3$ of fabric 38 transverse to axis 42, which in turn will correlate to the width $W_4$ of the bed sheet 50, as will be described. Each colored filling yarn 44' is spaced a predetermined distance from an adjacent colored filling yarn along the length of the fabric 38, so as to have one of the yarns located in a preselected section of a bed sheet 50 made from the fabric 38. In addition, each colored filling yarn 44' extends from the first selvage 46 to the second selvage 48. For the sake of illustration, warp yarn 44' is shown as having a green color.

The fabric 38 may have any weave pattern desired, and may be made using any suitable method(s) and materials. Also, the size-identification system may be achieved in any suitable fashion, as discussed above in connection with the fabric 12 of FIG. 1.

Figure 4:
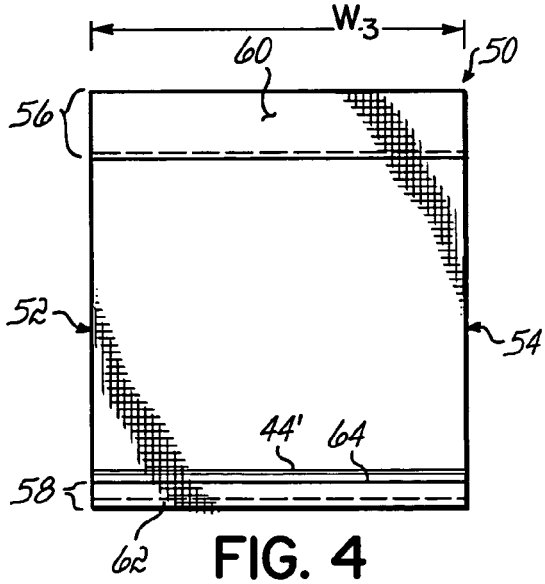
FIG. 4 is an elevational view of a flat bed sheet made from the fabric of FIG. 2.

With reference to FIG. 4, the flat bed sheet 50 made from the fabric 38 of FIG. 3 has a first selvage 52 and a second selvage 54 corresponding with the selvages 46, 48 of the fabric 38. The sheet 50 also has upper- and lower-end sections 56, 58, each of which includes a hem 60, 62. The sheet 50 has been cut and sewn so that a colored filling yarn 64 is located in the lower-end section 58, just above the hem 62—the colored filling yarn 64 corresponding with a colored filling yarn 44' of the fabric 38.

In another embodiment (not shown), a flat bed sheet made from a fabric substantially similar to that of FIG. 3 includes a first selvage, a second selvage, an upper-end section, and a lower-end section, with each of the end sections including a hem. In addition, the sheet has a first colored filling yarn in the upper-end section, and a second colored filling yarn in the lower-end section. Prior to weaving the fabric used to make the sheet, the distance between adjacent colored filling yarns for the fabric is established, thereby enabling the resulting sheet to have the colored filling yarn in both the upper- and lower-end sections.

In use, a fabric may be woven, in which at least one of the warp and/or filling yarns has a predetermined color correlated to an intended size of bed sheets to be made from the fabric. Individual sheets may be made from the fabric, with each of the sheets including at least a portion of the colored yarn, the portion being visible to the naked eye. In this fashion, a person readily may distinguish between bed sheets of different size by looking at the particular colors of the visible portions of the colored yarns.

Each of the woven greige fabrics and bed sheets described above provides several benefits and advantages. For example, a laundry- or housekeeping-worker quickly and easily may see the color coding on a particular bed sheet, and immediately know the size of the item—thereby resulting in reduced handling time, which translates to greater worker productivity and reduced labor costs. Also, because the color-coded yarn is an integral part of the woven fabric, the color-coding system is more durable, and the color-coded products may be made without additional steps. Accordingly, the color-coded products are less expensive to make.

By virtue of the foregoing, there is a size-identification system for bed sheets and the like which has advantages over prior bed-sheet size indicators.

While the present invention has been illustrated by a description of embodiments, and while the illustrative embodiments have been described in considerable detail, it is not the intention of the inventor to restrict or in any way limit the scope of the appended claims to such detail. Additional advantages and modifications readily will appear to those skilled in the art. For example, although several of the drawings illustrate bed sheets, the fabrics of the invention may be used to form blankets, towels, pillow cases, and other sized-specific flat-goods. The invention in its broader aspects is therefore not limited to the specific details, representative apparatus and methods, and illustrative examples shown and described. Accordingly, departures may be made from such details without departing from the spirit or scope of the inventor's general inventive concept.

What is claimed is:

1. A method of making a bed sheet in which the bed sheet includes an integrally woven size indicator, the method comprising the steps of:

obtaining a length of woven fabric comprising a plurality of warp yarns and filling yarns simultaneously woven together, at least one of the warp yarns having a predetermined color correlated to an intended size of the bed sheet to be made from the length of woven fabric, the colored warp yarn being in a selvage of the woven fabric and being of a similar composition to the plurality of warp yarns; and converting the length of the woven fabric into a bed sheet having a lengthwise edge, with the colored warp yarn being located proximate the lengthwise edge, and at least a portion of the colored warp yarn being visible to the naked eye, whereby a person readily may determine the size of the bed sheet by looking at the visible portion of the colored warp yarn.

2. The method of claim 1 wherein the converting step includes cutting a portion of the woven fabric from the length thereof.

3. The method of claim 2 wherein the converting step further includes sewing an edge of the cut portion of the woven fabric.

4. The method of claim 1 wherein the converting step includes sewing a plurality of edges of the woven fabric.

5. The method of claim 1 wherein the obtaining step includes obtaining the length of woven fabric as a greige fabric.

6. The method of claim 5 wherein the converting step includes finishing the length of woven greige fabric.

7. The method of claim 1 wherein the obtaining step includes obtaining the length of woven fabric with the colored warp yarn having a second different predetermined color.

8. The method of claim 1 wherein the obtaining step includes obtaining the length of woven fabric with a plurality of colored warp yarns, at least one of the colored warp yarns having a different predetermined color.

9. A method of making a bed sheet in which the bed sheet includes an integrally woven size indicator, the method comprising the steps of:

obtaining a length of woven fabric comprising a plurality of warp yarns and filling yarns simultaneously woven together, at least one of the yarns having a predetermined color correlated to an intended size of the bed sheet to be made from the length of woven fabric, the colored yarn being in a selvage of the woven fabric and being of a similar composition to the plurality of warp or filling yarns; and converting the length of the woven fabric into a bed sheet, with the colored yarn being located proximate an edge of the bed sheet and at least a portion of the colored yarn being visible to the naked eye, whereby a person readily may determine the size of the bed sheet by looking at the visible portion of the colored yarn.

10. A bed sheet including an integrally woven size indicator, comprising:

a plurality of warp yarns and filling yarns simultaneously woven together, at least one of the warp yarns having a predetermined color correlated to the size of the bed sheet, the colored warp yarn being of a similar composition to the plurality of warp yarns and being located in a selvage proximate a lengthwise edge of the bed sheet, with at least a portion of the colored warp yarn being visible to the naked eye, whereby a person readily may determine the size of the bed sheet by looking at the visible portion of the colored warp yarn.

11. A method of making a woven greige fabric, the woven greige fabric for making a bed sheet which includes an integrally woven size indicator, the method comprising the step of:

simultaneously weaving together a plurality of warp yarns and filling yarns so as to form a woven greige fabric, with at least one of the warp yarns having a predetermined color correlated to an intended size of the bed sheet to be made from the woven greige fabric, the colored warp yarn being located in a selvage of the woven greige fabric and being of a similar composition to the plurality of warp yarns, at least a portion of the colored warp yarn being visibly located proximate a lengthwise edge of a bed sheet made from the woven greige fabric, whereby a person readily may determine the size of the bed sheet by looking at the visibly-located colored warp yarn.

12. A method of making a woven greige fabric, the woven greige fabric for making a bed sheet which includes an integrally woven size indicator, the method comprising the step of:

simultaneously weaving together a plurality of warp yarns and filling yarns so as to form a woven greige fabric, with at least one of the yarns having a predetermined color correlated to an intended size of the bed sheet to be made from the woven greige fabric, the colored yarn being located in a selvage of the woven greige fabric and being of a similar composition to the plurality of warp or filling yarns, at least a portion of the colored yarn being visibly located proximate an edge of the bed sheet made from the woven greige fabric, whereby a person readily may determine the size of the bed sheet by looking at the visibly-located colored yarn.

13. The method of claim 12 wherein the weaving step includes weaving the colored yarn in the filling direction.

14. The method of claim 13 wherein the weaving step includes predetermining where, in the fabric, the colored filling yarn will be woven, so as to have the colored filling yarn in a preselected section of the bed sheet.

15. The method of claim 13 wherein the woven greige fabric includes a plurality of color-coded filling yarns, and the weaving step includes predetermining the spacing between the color-coded filling yarns to be woven, so as to have at least one of the color-coded filling yarns located in at least one preselected section of the bed sheet.

16. A method of making a flat-good textile product in which the flat-good textile product includes an integrally woven size indicator, comprising the steps of:

obtaining a woven fabric having a length and comprising a plurality of warp yarns and filling yarns simultaneously woven together, at least one of the yarns having a predetermined color correlated to an intended size of the flat-good textile product made from the woven fabric, the colored yarn being located in a selvage of the woven fabric and being of a similar composition to the plurality of warp or filling yarns; and converting at least a portion of the length of the woven fabric into a flat-good textile product, with at least a portion of the colored yarn being visibly located proximate an edge of the flat-good textile product, whereby a person readily may determine the size of the flat-good textile product by looking at the visibly-located color-coded yarn.

* * * * *